United States Patent [19]

Alwine et al.

[11] Patent Number: 5,032,085

[45] Date of Patent: Jul. 16, 1991

[54] ELECTRICAL CONNECTOR, AND HOUSING AND CONTACTS THEREFOR

[75] Inventors: K. Troy Alwine, Warren, Pa.; Frederick H. Rider, Glendale, Ariz.; Christopher T. Thibodeau, Westland; Manfred W. Wippich, Grosse Ile, both of Mich.

[73] Assignees: GTE Products Corp., Stamford, Conn.; Ford Motor Corp., Dearborn, Mich.

[21] Appl. No.: 485,191

[22] Filed: Feb. 26, 1990

[51] Int. Cl.[5] ..... H01R 9/09

[52] U.S. Cl. ..... 439/79; 439/80; 439/936

[58] Field of Search ..... 439/76, 78–81, 439/83, 276, 870, 876, 891, 936

[56] References Cited

U.S. PATENT DOCUMENTS

| | | | |
|---|---|---|---|
| 3,864,000 | 2/1975 | Coller et al. | 439/246 |
| 4,756,696 | 7/1988 | Whiteman, Jr. | 439/79 |
| 4,789,346 | 12/1988 | Frantz | 439/80 |
| 4,820,196 | 4/1989 | Roselle et al. | 439/936 |
| 4,867,690 | 9/1989 | Thumma | 439/79 |
| 4,898,215 | 2/1990 | Jones | 140/105 |

OTHER PUBLICATIONS

Amp Inc, "Electronic" Sep. 11, 1972 p. 172.

*Primary Examiner*—Paula A. Bradley
*Attorney, Agent, or Firm*—William H. McNeill

[57] ABSTRACT

An electrical connector with three rows of contacts undergoing right angle bends to form two columns suitable for joining to a printed circuit board. The distal portions of the contacts are retained in a contact receiving wall provided with contact receiving slots equipped with spring back guards. This feature allows the resilience of the contact material to aid in maintaining contact alignment. Provision is made with the connector body to receive an environment sealing compound.

15 Claims, 5 Drawing Sheets

ELECTRICAL CONNECTOR, AND HOUSING AND CONTACTS THEREFOR

TECHNICAL FIELD

This invention relates to electrical connectors, housings for electrical connectors and electrical contacts therefor. More particularly, the invention relates to such connectors utilizing contacts which are formed with a substantially right angle bend. Still more particularly, the invention is concerned with such connectors having applicability with printed circuit boards.

BACKGROUND ART

As electrical connectors acquire a greater amd greater density of contacts the problem of alignment of the contacts also increases. This may be especially true in those connectors employing double ended male contacts which project to some degree from the connector body.

SUMMARY OF THE INVENTION

It is, therefore, an object of this invention to obviate the disadvantages of the prior art.

It is another object of the invention to enhance electrical connectors.

Still another object of the invention is the provision of a high density electrical contact connector having means for preserving the contact alignment. Yet another object of the invention is the provision of an electrical connector that is rugged and that can have its individual contacts sealed against the environment.

Some of these objects are accomplished, in one aspect of the invention, by the provision of an electrical connector which has a body having a housing formed from an electrically insulating material. The housing has spaced apart upper and lower surfaces and the upper surface has a plurality of electrical contact receiving apertures contained in first, second and third longitudinal arrays. The lower surface is provided with a plurality of bend anvils in first, second and third longitudinal arrays, with each array of the bend anvils being operatively associated with a respective one of the first, second and third longitudinal arrays of the plurality of apertures. A contact receiving wall depends from the lower surface, near a periphery thereof, and the contact receiving wall comprises a plurality of longitudinally arrayed contact receiving slots, with each of the contact receiving slots being provided with one contact spring-back guard and every other one of the slots being provided with second contact spring-back guards. The slots have an axis normal to the lower surface and the two contact spring-back guards are axially spaced apart along the axis. First, second and third electrical contacts are positioned respectively in the first, second and third longitudinal arrays. The contacts have proximal blade portions extending from the upper surface and central body portions extending from the lower surface and respectively engaging the bend anvils of the first, second and third arrays and changing direction 90 degrees where the bend anvils are engaged. The second and third electrical contacts have distal portions projecting beyond the contact receiving wall, and have areas adjacent the distal portions which are received in adjacent ones of the slots and in engagement with the contact spring-back guards. The distal portions of the second and third contacts are interdigitated with one another and lie in a single plane. The first electrical contacts have distal portions projecting beyond the wall and have areas adjacent the distal portions which are received in the slots and in engagement with the second of the contact spring-back guards. The first contact distal portions overlie the second contact distal portions, with all of the first contact distal portions lying in a single plane.

In an alternate embodiment the longitudinal arrays of contact receiving apertures are provided with sealing material receiving troughs.

Other objects of the invention are carried out by the provision of a connector body which comprises a housing formed from an electrically insulating material. The housing has spaced apart upper and lower surfaces and the upper surface has a boss which contains a plurality of electrical contact receiving apertures in multiple longitudinal arrays, each of the longitudinal arrays being provided with a sealing material receiving trough.

The lower surface is provided with a plurality of bend anvils in longitudinal array, each array of bend anvils being operatively associated with one of the multiple arrays of the plurality of apertures.

Still further objects of the invention are supplied by the provision of an electrical contact system for an electrical connector which system comprises first, second and third electrical contacts with the first electrical contact comprising a proximal blade portion having a given thickness and a given width; a first central body portion depending from the proximal blade portion and having said given thickness and a second width which is less than said given width, whereby a pair of shoulders is formed at the jointure of said blade portion and the first central portion. A second central portion is attached to and depends from the first central portion, the second central portion having said given thickness and a third width which is less than said second width. A third central portion has said given thickness and a width equal to said second width, and a distal portion has a thickness less than said given thickness and a fourth width less than said third width. The second contact comprises a blade portion having said given thickness and said given width, and a central body portion having said given thickness and a width equal to said third width, and a distal portion having a thickness less than said given thickness and a fourth width less than said third width. The third contact comprises a blade portion having said given thickness and said given width, and a central body portion having said given thickness and a width equal to said third width, and a distal portion having a thickness less than said given thickness and a fourth width less than said third width. The first contact has a given length; the second contact has a length less than said given length; and the third contact has a length less than the length of the second contact.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
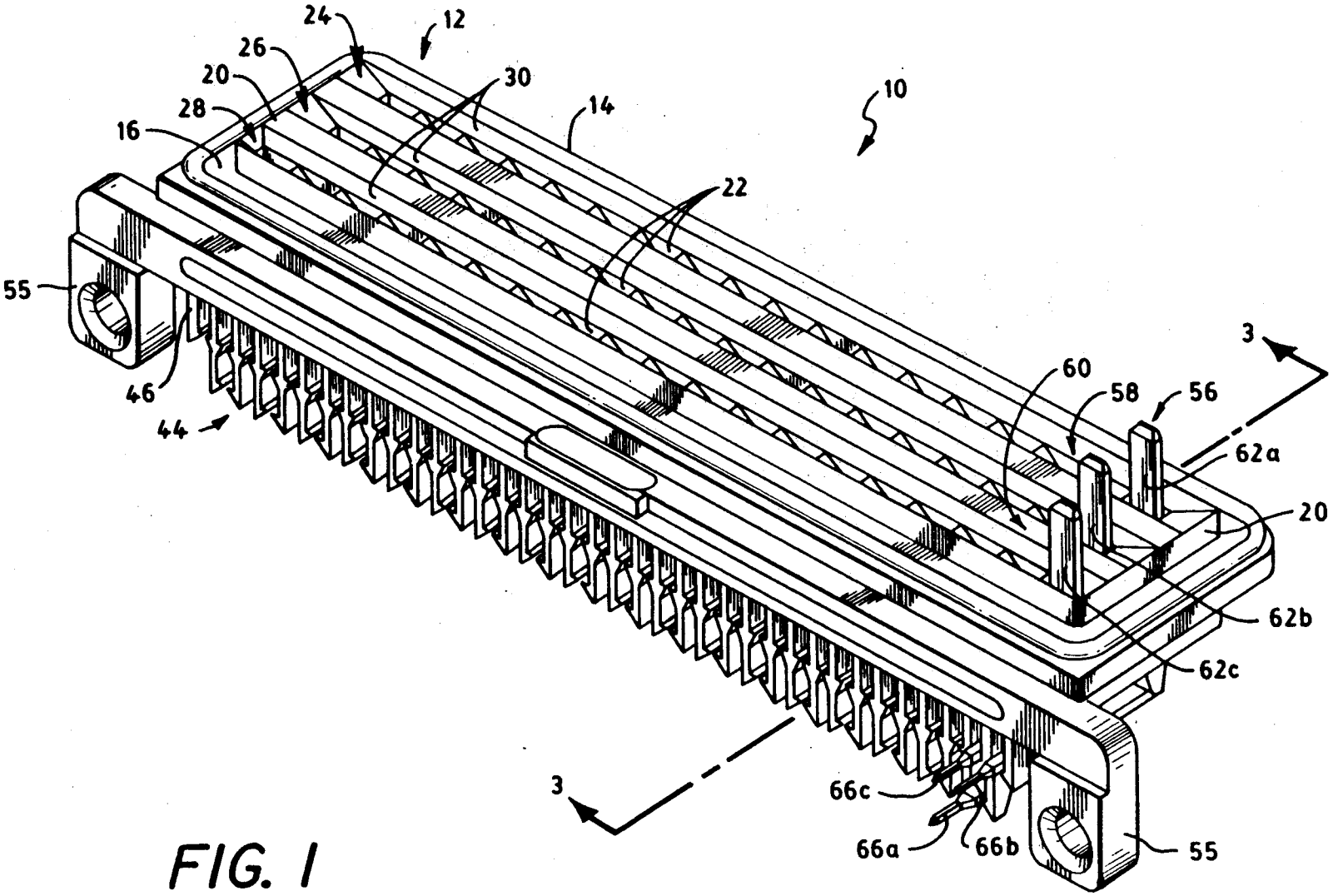
FIG. 1 is a top perspective view of an embodiment of the connector of the invention.
Figure 2:
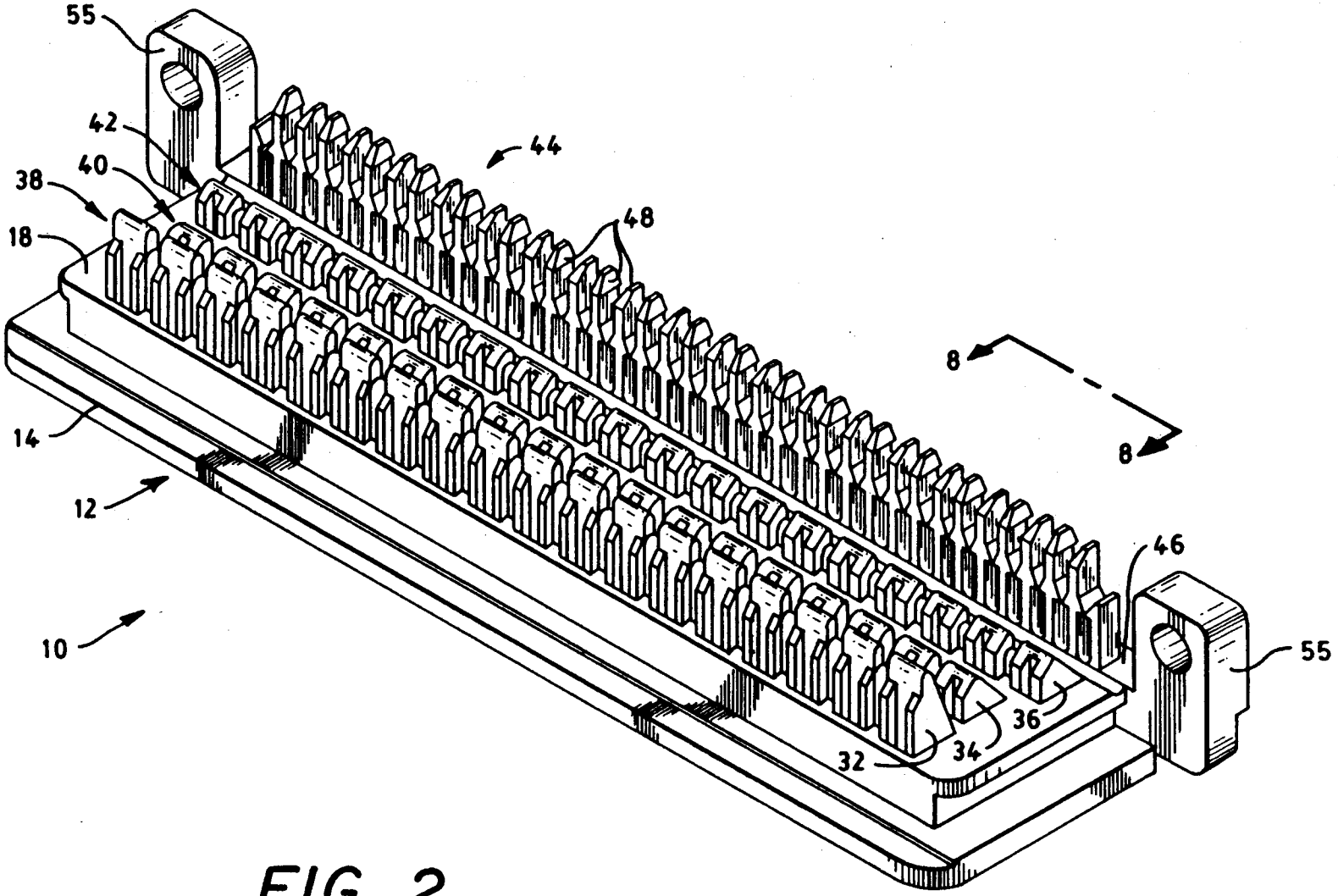
FIG. 2 is a bottom perspective view of an embodiment of the invention.
Figure 3:
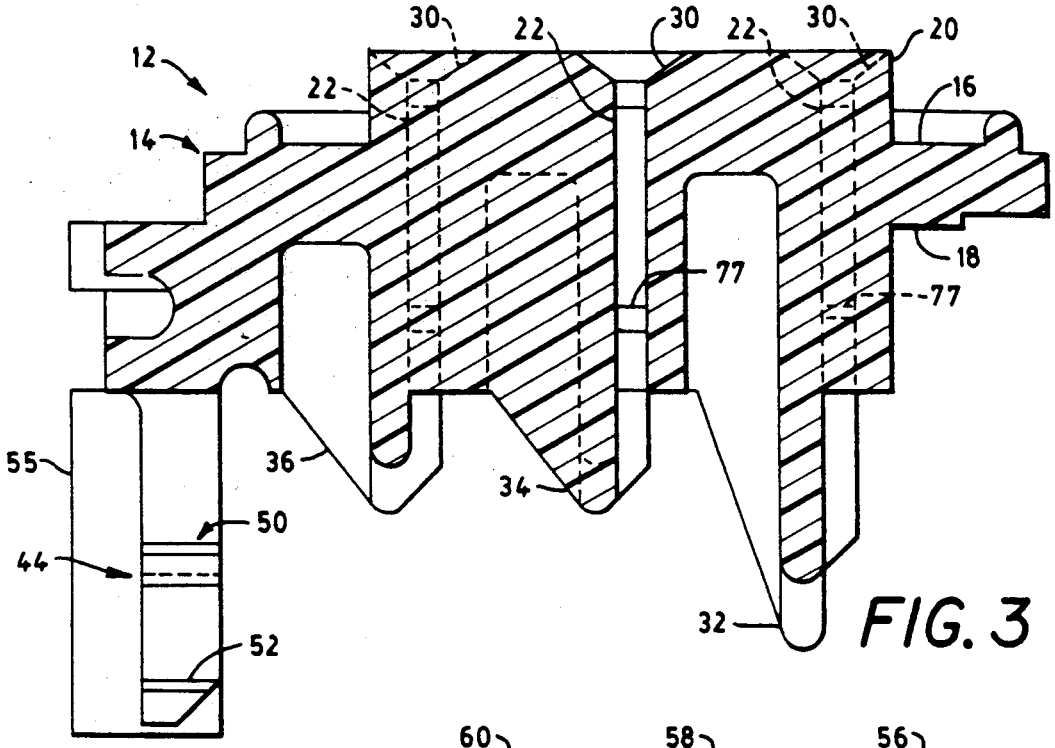
FIG. 3 is a sectional elevational view taken along the line 3—3 of FIG. 1.
Figure 8:
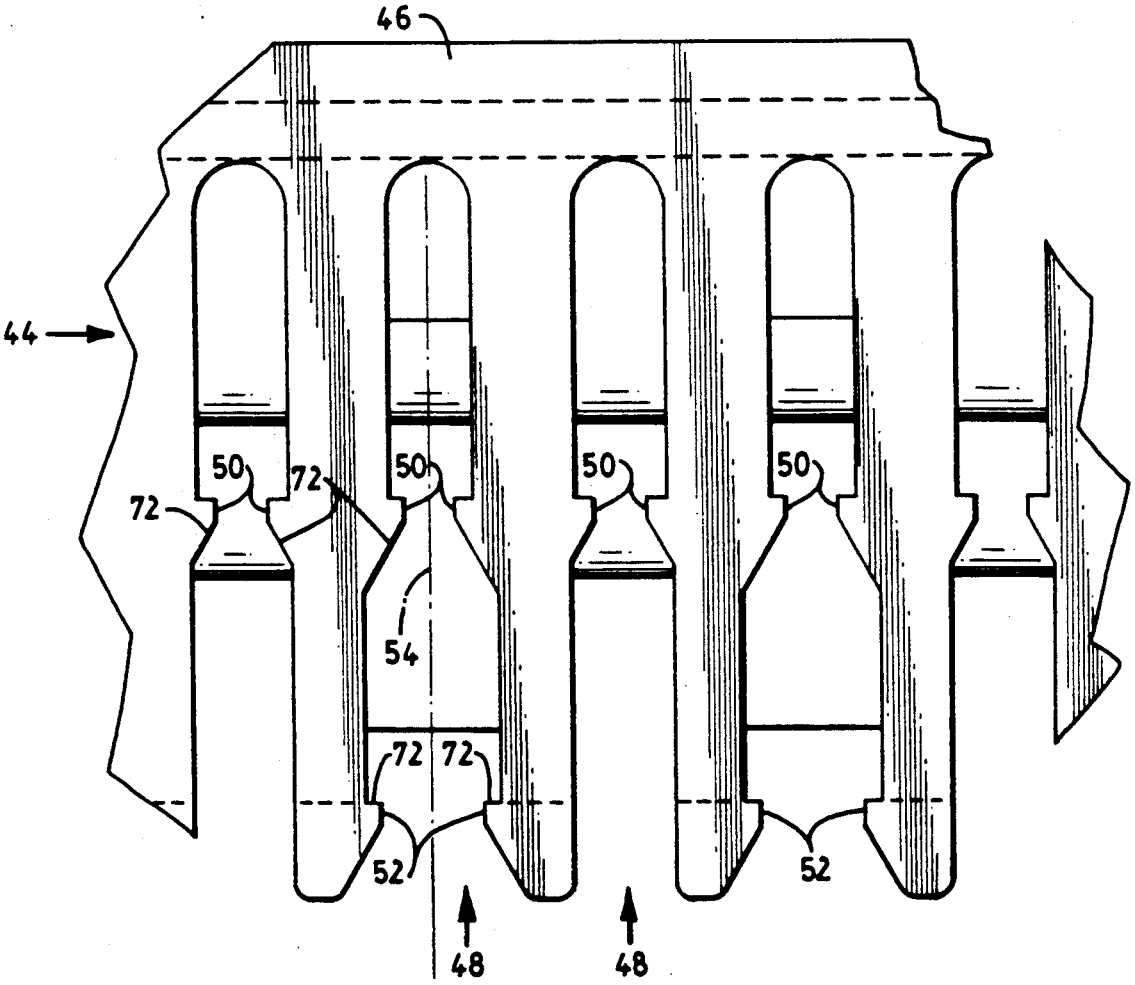
FIG. 8 is an elevational view of contact spring-back guards looking in the direction of lines 8—8 of FIG. 2.

Referring now to the drawings with greater particularity, there is shown in FIGS. 1 and 2 an electrical connector 10 which has a body 12 having a housing 14 formed from an electrically insulating material such as VALOX 508 (TM), which is available from the General Electric Company. This material is suitable for molding precision connector bodies which are substantially warp-free. The housing 14 has spaced apart upper and lower surfaces 16 and 18, respectively. The upper surface 16 has a boss 20 containing a plurality of electrical contact receiving apertures 22 contained in first, second and third longitudinal arrays, 24, 26, 28, respectively. Each of these longitudinal arrays is provided with a sealing material receiving trough 30. The lower surface 18 is provided with a plurality of bend anvils 32, 34, 36, in first, second and third longitudinal arrays, 38, 40, 42, with each array of the bend anvils being operatively associated with a respective one of the first, second and third longitudinal arrays of the plurality of apertures 22. A contact receiving wall 44 depends from the lower surface 18, near a periphery 46 thereof. The contact receiving wall 44 comprises a plurality of longitudinally arrayed, precision aligned, contact receiving slots 48, with each of the contact receiving slots being provided with one contact spring-back guard 50 and every other one of the slots being provided with a second contact spring-back guard 52 (See FIG. 8). The slots 48 have an axis 54 normal to the lower surface and the contact spring-back guards 50 and 52 are axially spaced apart along the axis 54. Suitably apertured mounting lugs 55 can be provided on the ends of connector body 14.

Figure 4:
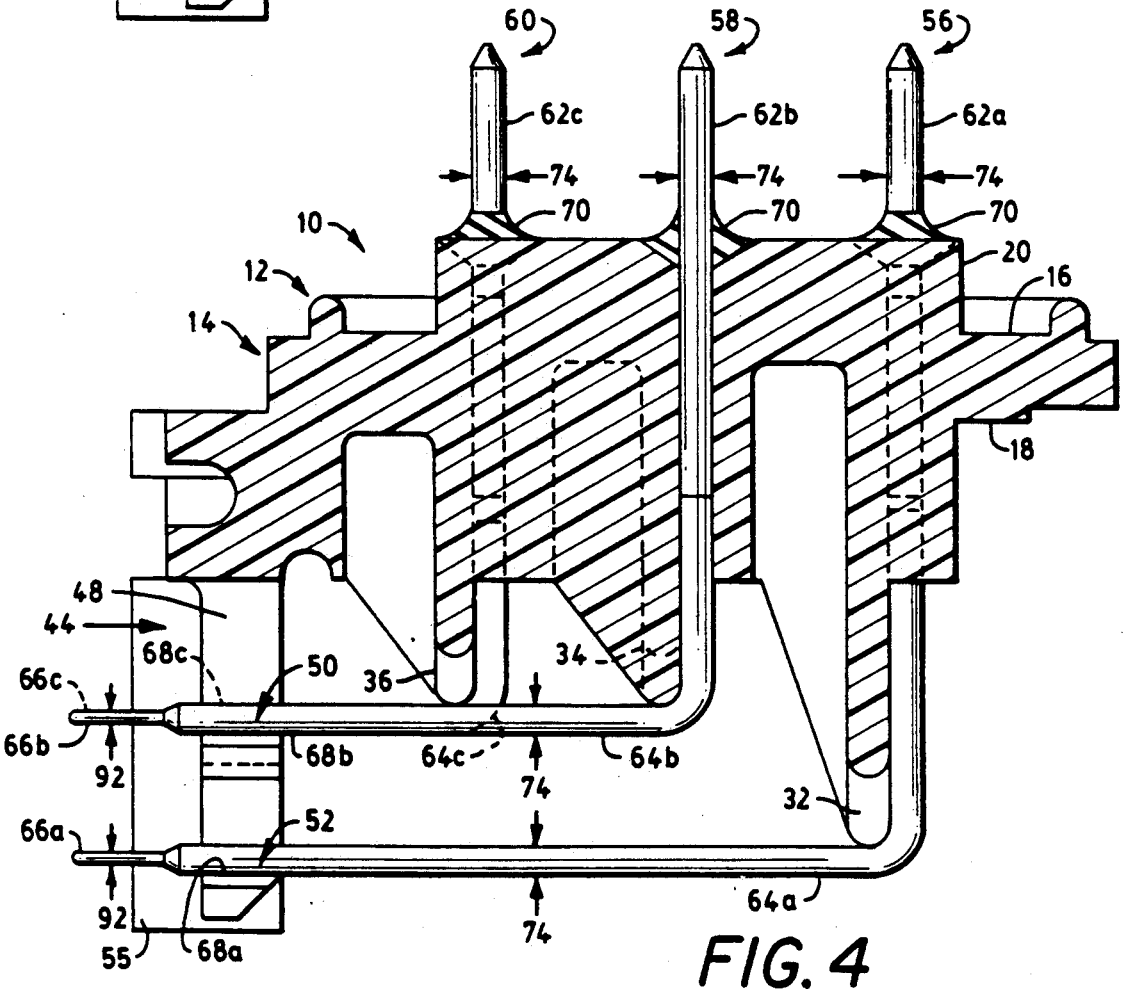
FIG. 4 is a view similar to FIG. 3 with the electrical contacts in place.

First, second and third electrical contacts 56, 58, 60, respectively, are positioned in the first, second and third longitudinal arrays. The contacts have proximal blade portions **62*a*, 62*b*, 62*c*, extending from the upper surface 16 and central body portions 64*a*, 64*b*, 64*c*, extending from the lower surface 18 and respectively engaging the bend anvils of the first, second and third arrays and changing direction 90 degrees where the bend anvils are engaged. (See FIG. 4). The second and third electrical contacts 58, 60, have distal portions 66*b*, 66*c*, projecting beyond the contact receiving wall 44, and have areas 68*b*, 68*c*, adjacent the distal portions which are received in adjacent ones of the slots 48 and in engagement with the contact spring-back guards 50. The distal portions 66*b*, and 66*c* of the second and third contacts are interdigitated with one another and lie in a single plane. (See FIG. 1 where, for clarity, only three contacts are shown) The first electrical contacts 56 have distal portions 66*a* projecting beyond the wall 44 and have areas 68*a* adjacent the distal portions 66*a* which are received in the slots 48 and in engagement with the second of the contact spring-back guards 52. The first contact distal portions 66*a* overlie the second contact distal portions, with all of the first contact distal portions lying in a single plane. Thus, the three rows of contacts are developed into two rows after the right angle bend. A contact sealing material 70 fills in the the troughs 30**. A preferred sealing material is ENVIBAR (TM) UV1244, an ultra-violet light activated material available from the Union Carbide Corporation.

The contact spring back guards 50 and 52 include nubbins 72 which project inwardly toward axis 54. The nubbins define a space less than the width of the contact with which they are associated. This feature takes advantage of the fact that, normally, to bend a contact 90 degrees, it would be necessary to overbend the contact to account for the memory of the contact material and its tendency to partially spring back toward its original position. In the instant connector, however, the inwardly projecting nubbins 72, which are tapered and whose walls exhibit a slight resiliency, allow the contacts to enter the slots 48, but then restrain them from springing back. This utilizes the inherent spring back qualities of the contacts to maintain alignment.

Figure 5:
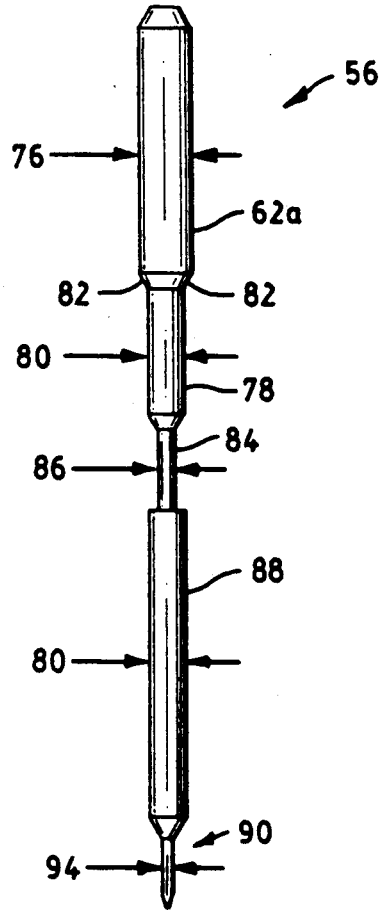
FIG. 5 is an elevational view of a first electrical contact.
Figure 6:
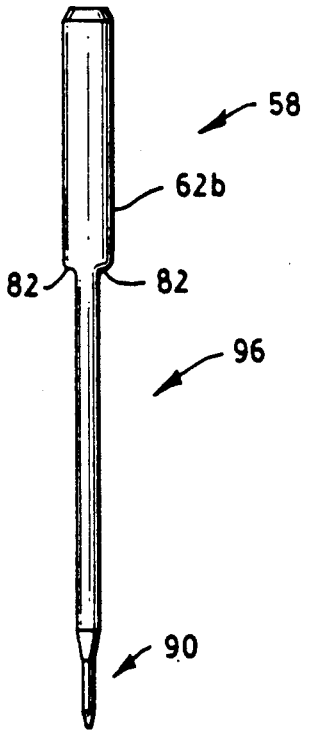
FIG. 6 is an elevational view of a second electrical contact.
Figure 7:
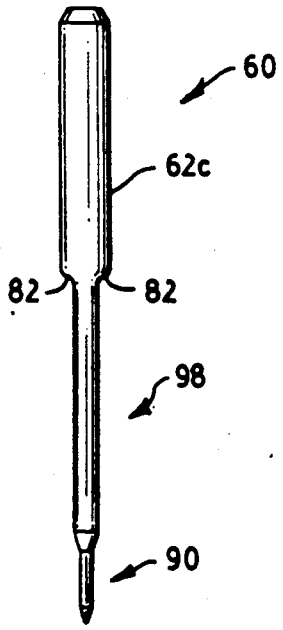
FIG. 7 is an elevational view of a third electrical contact.

The electrical contact system for electrical connector 10 is depicted in FIGS. 5–7 and comprises first, second and third electrical contacts 56, 58, 60, respectively. The first electrical contact 56 has a proximal blade portion **62*a* which has a thickness 74 (See FIG. 4), and a width 76. A first central body portion 78 depends from the proximal blade portion 62*a* and has the given thickness 74 and a second width 80 which is less than width 76, thus forming a pair of shoulders 82 at the jointure of the blade portion 62*a* and the first central portion 78. The shoulders 82 rest on the floor 77 of the apertures 22. A second central portion 84 is attached to and depends from the first central portion 78. The second central portion 84 has thickness 74 and a third width 86 which is less than second width 80. A third central portion 88 has thickness 74 and a width 80. A distal portion 90 has a thickness 92 (See FIG. 4) which is less than thickness 74, and a fourth width 94 which is less than third width 86**.

The second contact 58 comprises a blade portion **62*b* which, in this instance, is identical to blade portion 62*a*. A central body portion 96 has thickness 74 and a width 86, shoulders 82 and a distal portion 90**.

The third contact 60 comprises a blade portion **62*c* which is identical to blade portions 62*a* and 62*b*. The central body portion 98 has thickness 74, width 86, shoulders 82, and a distal portion 90**.

The first contact 56 has a given length; the second contact 58 has a length less than the given length; and the third contact has a length less than the length of the second contact.

In the preferred embodiment, the contacts have a given thickness of 0.800 mm and the distal portions are 0.500 mm square. Contact 56 has a length of 50.56 mm; contact 58 has a length of 44.45 mm; and contact 60 has a length of 34.56 mm. The preferred material is cartridge brass, i.e., 70% by weight copper and 30% by weight zinc. The contacts can be plated with matte nickel to a thickness in the range of about 50–150 micro inches and be over plated with a tin-lead material having a composition of 60% by weight tin and 40% by weight lead to a thickness in the range of about 150–300 micro inches.

Thus, there is provided by this invention an electrical connector, housing and electrical contact system therefor that obviates many of the disadvantages of the prior art. It is rugged and compact and has relatively high contact density. It employs right angle contacts and reduces three rows of contacts to two columns, with the two columns being held in alignment by the inherent tension of the contact material cooperating with spring back guards formed in the connector body.

The preferred embodiment shown herein comprises dual ended male contacts with the bladed end being suitable for engagement with a female connector and the thinner distal ends being suitable for mating with a printed circuit board.

While there have been shown and described what are at present considered to be the preferred embodiments of the invention, it will be apparent to those skilled in the art that various changes and modifications can be made herein without departing from the scope of the invention as defined by the appended claims.

We claim:

1. A connector body comprising: a housing formed from an electrically insulating material, said housing having spaced apart upper and lower surfaces; said upper surface having a boss containing a plurality of electrical contact receiving apertures in three longitudinal arrays, each of said longitudinal arrays being provided with a sealing material receiving trough; said lower surface being provided with a plurality of bend anvils in three longitudinal arrays, each array of said bend anvils being operatively associated with one of said multiple arrays of said plurality of apertures, one of said longitudinal arrays of bend anvils having a height, measured from said lower surface, which is greater than the height of another of said longitudinal arrays of bend anvils, and two of said longitudinal arrays of bend anvils having the same height.

2. The connector body of claim 1 wherein said lower surface has a contact receiving wall depending therefrom.

3. The connector body of claim 2 wherein said contact receiving wall comprises a plurality of longitudinally arrayed contact receiving slots.

4. The connector body of claim 3 wherein each of said contact receiving slots is provided with at least one contact spring-back guard.

5. The connector body of claim 4 wherein every other one of said contact receiving slots is provided with two contact spring-back guards.

6. An electrical contact system for an electrical connector comprising: first, second and third electrical contacts, said first electrical contact comprising a proximal blade portion having a given thickness and a given width; a first central body portion depending from said proximal blade portion having said given thickness and a second width which is less than said given width, whereby a pair of shoulders is formed at the jointure of said blade portion and said first central portion; a second central portion attached to and depending from said first central portion, said second central portion having said given thickness and a third width which is less than said second width; a third central portion having said given thickness and a width equal to said second width; and a distal portion having a thickness less than said given thickness and a fourth width less than said third width; said second contact comprising a blade portion having said given thickness and said given width; and a central body portion having said given thickness and a width equal to said third width; and a distal portion having a thickness less than said given thickness and a fourth width less than said third width; said third contact comprising a blade portion having said given thickness and said given width; and a central body portion having said given thickness and a width equal to said third width; and a distal portion having a thickness less than said given thickness and a fourth width less than said third width, said first contact having a given length, said second contact having a length less than said given length, and said third contact having a length less than the length of said second contact.

7. The electrical contact system of claim 6 wherein said contacts are made from cartridge brass.

8. The electrical contact system of claim 7 wherein said contacts are plated with matte nickel having a thickness in the range of 50 to 150 micro inches.

9. The electrical contact system of claim 8 wherein said nickel plated contacts are post plated with a tin-lead composition having 60% by weight tin to 40% by weight lead and a thickness in the range of about 150 to 300 micro inches.

10. An electrical connector comprising: a body having a housing formed from an electrically insulating material, said housing having spaced apart upper and lower surfaces; said upper surface having a boss containing a plurality of electrical contact receiving apertures in multiple longitudinal arrays, each of said longitudinal arrays being provided with a sealing material receiving through; said lower surface being provided with a plurality of bend anvils in longitudinal array, each array of said bend anvils being operatively associated with one of said multiple arrays of said plurality of apertures; electrical contacts fitted in at least some of said apertures, at least some of said contacts comprising a proximal blade portion extending from said upper surface, a central portion extending from said lower surface and engaging one of said bend anvils and changing direction approximately 90 degrees, the distal portion of said electrical contact extending beyond a contact receiving wall depending from the peryphery of said lower surface, said contact receiving wall comprising a plurality of longitudinally arrayed contact receiving slots, each of said contact receiving slots being provided with at least one contact spring-back guard, and an area of said contact adjacent said distal portion engaging one of said contact spring-back guards; and a contact sealing material being present in said troughs.

11. The electrical connector of claim 10 wherein said housing includes a pair of mounting lugs positioned on extreme ends thereof.

12. An electrical connector comprising: a body having a housing formed from an electrically insulating material, said housing having spaced apart upper and lower surfaces; said upper surface having a plurality of electrical contact receiving apertures in first, second and third longitudinal arrays; said lower surface being provided with a plurality of bend anvils in first, second and third longitudinal arrays, each array of said bend anvils being operatively associated with a respective one of said first, second and third longitudinal arrays of said plurality of apertures; a contact receiving wall depending from said lower surface, near a periphery thereof, said contact receiving wall comprising a plurality of longitudinally arrayed contact receiving slots, each of said contact receiving slots being provided with one contact spring-back guard and every other one of said slots being provided with two contact spring-back guards, said slots having an axis normal to said lower surface and said two contact spring-back guards being axially spaced apart along said axis normal to said lower surface; first, second and third electrical contacts positioned respectively in said first, second and third longitudinal arrays, said contacts having proximal blade portions extending from said upper surface and central body portions extending from said lower surface and respectively engaging said bend anvils of said first, second and third arrays and changing direction 90 degrees where said bend anvils are engaged, said second and third electrical contacts having distal portions projecting beyond said contact receiving wall, and having areas adjacent said distal portions which are received in adjacent ones of said slots and in engagement with said contact spring-back guards, said distal portions of said second and third contacts being interdigitated with one another and lying in a single plane; said first electrical contacts having distal portions projecting beyond said wall and having areas adjacent said distal portions which are received in said slots and in engagement with the second of said contact spring-back guards, said first contact distal portions overlying said second contact distal portions, with all of said first contact distal portions lying in a single plane.

13. The electrical connector of claim 12 wherein said housing includes a pair of mounting lugs positioned on extreme ends thereof.

14. An electrical connector comprising: a body having a housing formed from an electrically insulating material, said housing having spaced apart upper and lower surfaces; said upper surface having a boss containing a plurality of electrical contact receiving apertures in first, second and third longitudinal arrays, each of said longitudinal arrays being provided with a sealing material receiving trough; said lower surface being provided with a plurality of bend anvils in first, second and third longitudinal arrays, each array of said bend anvils being operatively associated with a respective one of said first, second and third longitudinal arrays of said plurality of apertures; a contact receiving wall depending from said lower surface, near a periphery thereof, said contact receiving wall comprising a plurality of longitudinally arrayed contact receiving slots, each of said contact receiving slots being provided with one contact spring-back guard and every other one of said slots being provided with two contact spring-back guards, said slots having an axis normal to said lower surface and said two contact spring-back guards being axially spaced apart along said axis normal to said lower surface; first, second and third electrical contacts positioned respectively in said first, second and third longitudinal arrays, said contacts having proximal blade portions extending from said upper surface and central body portions extending from said lower surface and respectively engaging said bend anvils of said first, second and third arrays and changing direction 90 degrees where said bend anvils are engaged, said second and third electrical contacts having distal portions projecting beyond said contact receiving wall, and having areas adjacent said distal portions which are received in adjacent ones of said slots and in engagment with said contact spring-back guards, said distal portions of said second and third contacts being interdigitated with one another and lying in a single plane; said first electrical contacts having distal portions projecting beyond said wall and having areas adjacent said distal portions which are received in said slots and in engagement with the second of said contact spring-back guards, said first contact distal portions overlying said second contact distal portions, with all of said first contact distal portions lying in a single plane; and a contact sealing material in each of said troughs.

15. The electrical connector of claim 14 wherein said housing includes a pair of mounting lugs positioned on extreme ends thereof.

* * * * *

UNITED STATES PATENT AND TRADEMARK OFFICE

CERTIFICATE OF CORRECTION

PATENT NO. : 5,032,085

DATED : Jul. 16, 1991

INVENTOR(S) : K.Troy Alwine, Frederick H. Rider, Christopher T. Thibodeau, Manfred W. Wippich It is certified that error appears in the above-identified patent and that said Letters Patent is hereby corrected as shown below:

On the title page:

(73) Assignees: GTE Products Corporation, Stamford, Conn.
Ford Motor Company, Dearborn, Mich.

Signed and Sealed this

Twenty-second Day of December, 1992

*Attest:*

DOUGLAS B. COMER

*Attesting Officer*

*Acting Commissioner of Patents and Trademarks*